US010602826B2

(12) United States Patent
Wilkinson et al.

(10) Patent No.: US 10,602,826 B2
(45) Date of Patent: Mar. 31, 2020

(54) HAND HELD APPLIANCE

(71) Applicant: Dyson Technology Limited, Wiltshire (GB)

(72) Inventors: Christopher Daniel Currer Wilkinson, Swindon (GB); Oliver James Pelham Thorman, Hereford (GB); Antoine Francois Atkinson, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 400 days.

(21) Appl. No.: 15/159,083

(22) Filed: May 19, 2016

(65) Prior Publication Data

US 2016/0338465 A1 Nov. 24, 2016

(30) Foreign Application Priority Data

May 22, 2015 (GB) ..... 1508809.9

(51) Int. Cl.
*H01H 13/06* (2006.01)
*A45D 20/10* (2006.01)
(Continued)

(52) U.S. Cl.
CPC ..... *A45D 20/10* (2013.01); *A45D 20/12* (2013.01); *H01H 9/04* (2013.01); *H01H 9/06* (2013.01)

(58) Field of Classification Search
CPC ..... A45D 20/00; A45D 20/02; A45D 20/04; A45D 20/06; A45D 20/08; A45D 20/10; H01H 9/04; H01H 9/06; H01H 13/06
(Continued)

(56) References Cited

U.S. PATENT DOCUMENTS 3,085,140 A 4/1963 Roe
3,394,716 A * 7/1968 Andersen ..... A45D 24/30 132/125
(Continued)

FOREIGN PATENT DOCUMENTS

AU 21543/70 4/1972
CN 102058228 A 5/2011
(Continued)

OTHER PUBLICATIONS

Search Report dated Oct. 22, 2015, directed to GB Application No. 1508809.9; 1 page.
(Continued)

*Primary Examiner* — John P McCormack
(74) *Attorney, Agent, or Firm* — Morrison & Foerster LLP

(57) ABSTRACT

A hand held appliance comprising an outer wall, a user operable button, a switch mechanism, and a switch assembly wherein the switch assembly is housed within the outer wall and comprises a frame, an actuator and a flexible membrane which connects the actuator to the frame and wherein the actuator cooperates with both the switch mechanism and the user operable button. The outer wall may comprise an aperture and the user operable button engages with the actuator through the aperture. The user operable button may be spaced from the flexible membrane by the actuator. The actuator may comprise a recess which engages with a corresponding protrusion that extends from the user operable button. The actuator may comprise a second recess which engages with an activation knob of the switch mechanism. The second recess may be spaced from the recess. The flexible membrane may extend around the perimeter of the actuator.

26 Claims, 6 Drawing Sheets

(51) Int. Cl.

| | |
|---|---|
| ***A45D 20/12*** | (2006.01) |
| ***H01H 9/04*** | (2006.01) |
| ***H01H 9/06*** | (2006.01) |

(58) Field of Classification Search

USPC ..... 34/96, 283; 200/16 R, 19.06, 19.3, 33 C, 200/211, 213, 561.11, 51.12, 505, 522, 200/332.2, 520, 341, 302.2, 302.1, 302.3, 200/295, 293, 293.1, 245, 238, 239, 200/61.19, 5 R, 5 A, 294

See application file for complete search history.

(56) References Cited

U.S. PATENT DOCUMENTS

| | | | | |
|---|---|---|---|---|
| 3,928,742 | A | 12/1975 | Rule | |
| 3,932,722 | A | 1/1976 | Obata et al. | |
| 4,178,751 | A | 12/1979 | Liautaud | |
| 4,459,256 | A | 7/1984 | Ziegler | |
| 4,742,199 | A | 5/1988 | Andis et al. | |
| 4,766,271 | A | 8/1988 | Mitsuhashi et al. | |
| 4,833,283 | A | 5/1989 | Andis et al. | |
| 5,258,592 | A * | 11/1993 | Nishikawa | H01H 13/52 200/302.2 |
| 5,315,476 | A | 5/1994 | Hedrick | |
| 5,367,133 | A | 11/1994 | Schmidt et al. | |
| 5,489,754 | A | 2/1996 | Dirmeyer et al. | |
| 5,555,637 | A * | 9/1996 | Montagnino | A45D 20/10 34/97 |
| 5,567,047 | A | 10/1996 | Fritsch | |
| 5,574,253 | A | 11/1996 | Golob et al. | |
| 5,642,950 | A | 7/1997 | Hochgesang et al. | |
| 5,875,562 | A * | 3/1999 | Fogarty | A45D 20/10 34/97 |
| 6,000,842 | A | 12/1999 | Müller et al. | |
| 6,064,019 | A | 5/2000 | Buchan et al. | |
| 6,088,531 | A | 7/2000 | Endoh | |
| 6,107,583 | A | 8/2000 | Berfield | |
| 6,281,482 | B1 | 8/2001 | Chu | |
| 6,335,499 | B1 | 1/2002 | Kokubu et al. | |
| 6,376,790 | B1 | 4/2002 | Kawase | |
| 6,573,466 | B1 | 6/2003 | Rapp et al. | |
| 6,626,476 | B1 | 9/2003 | Govzman et al. | |
| 6,878,328 | B2 | 4/2005 | Boland et al. | |
| 7,636,977 | B2 | 12/2009 | Banning | |
| 7,705,255 | B2 * | 4/2010 | Yokote | H01H 13/06 200/302.2 |
| 7,804,034 | B2 | 9/2010 | Herzog et al. | |
| 8,115,126 | B2 * | 2/2012 | Deng | A61B 1/00142 200/302.2 |
| 8,647,748 | B2 | 2/2014 | Goerich et al. | |
| 9,066,577 | B1 | 6/2015 | Stoerkel et al. | |
| 2001/0017255 | A1 | 8/2001 | Katsumi | |
| 2003/0221267 | A1 | 12/2003 | Chan | |
| 2009/0239046 | A1 | 9/2009 | Vankov et al. | |
| 2009/0294265 | A1 | 12/2009 | Kleinlein et al. | |
| 2010/0162585 | A1 * | 7/2010 | Liu | A45D 20/12 34/97 |
| 2011/0035892 | A1 | 2/2011 | Baier et al. | |
| 2011/0247158 | A1 | 10/2011 | Jungnickel et al. | |
| 2012/0118601 | A1 | 5/2012 | Hite et al. | |
| 2012/0217141 | A1 | 8/2012 | Yamasaki et al. | |
| 2012/0325637 | A1 * | 12/2012 | Kikuchi | H01H 13/063 200/520 |
| 2013/0037397 | A1 | 2/2013 | Tittle | |
| 2013/0161165 | A1 | 6/2013 | Han | |
| 2013/0161168 | A1 * | 6/2013 | Botez | H01H 9/20 200/341 |
| 2013/0319836 | A1 | 12/2013 | Chen et al. | |
| 2014/0008192 | A1 | 1/2014 | Christophy et al. | |
| 2015/0007854 | A1 | 1/2015 | Moloney et al. | |

FOREIGN PATENT DOCUMENTS

| | | | |
|---|---|---|---|
| CN | 102686069 | A | 9/2012 |
| CN | 204117905 | U | 1/2015 |
| DE | 3033134 | | 5/1981 |
| DE | 4208087 | | 4/1993 |
| DE | 19740478 | | 3/1999 |
| DE | 10131218 | | 12/2002 |
| DE | 10300476 | | 7/2004 |
| DE | 10341141 | | 3/2005 |
| DE | 102006039372 | | 3/2008 |
| DE | 102008034046 | | 1/2009 |
| DE | 102008019822 | | 10/2009 |
| EP | 0600634 | | 6/1994 |
| EP | 0615265 | | 9/1994 |
| EP | 0684020 | | 11/1995 |
| EP | 0878814 | | 11/1998 |
| EP | 1054420 | | 11/2000 |
| EP | 1110365 | | 6/2001 |
| EP | 1422040 | | 5/2004 |
| GB | 2185855 | | 7/1987 |
| GB | 2214353 | | 8/1989 |
| GB | 2196792 | | 5/1998 |
| JP | 61-142338 | | 9/1986 |
| JP | 4-85540 | | 7/1992 |
| JP | 7-1546 | | 1/1995 |
| JP | 7-245039 | | 9/1995 |
| JP | 7-94137 | | 10/1995 |
| JP | 8-18249 | | 1/1996 |
| JP | 3312530 | | 11/1996 |
| JP | 9-1677 | | 1/1997 |
| JP | 9-1678 | | 1/1997 |
| JP | 9-312116 | | 12/1997 |
| JP | 2-915303 | | 4/1999 |
| JP | 2000-6187 | | 1/2000 |
| JP | 3-092841 | | 9/2000 |
| JP | 2002-313173 | | 10/2002 |
| JP | 2008-59808 | | 3/2008 |
| JP | 2015-13127 | | 1/2015 |
| WO | WO-88/03322 | | 5/1988 |
| WO | WO-02/064383 | | 8/2002 |
| WO | WO-03/044816 | | 5/2003 |
| WO | WO-2005/082636 | | 9/2005 |

OTHER PUBLICATIONS

International Search Report and Written Opinion dated Jul. 22, 2016, directed to International Application No. PCT/GB2016/051283; 11 pages.

Search Report dated Apr. 25, 2018, directed to GB Application No. 1720357.1; 1 page.

The First Office Action dated Dec. 26, 2018, directed to CN Application No. 201610344809.5; 24 pages.

* cited by examiner

HAND HELD APPLIANCE

REFERENCE TO RELATED APPLICATIONS

This application claims the priority of United Kingdom Application No. 1508809.9, filed May 22, 2015, the entire contents of which are incorporated herein by reference.

FIELD OF THE INVENTION

This invention relates to hand held appliance and in particular a hair care appliance.

BACKGROUND OF THE INVENTION

Generally, a motor and fan are provided which draw fluid into a body; the fluid may be heated prior to exiting the body. The motor is susceptible to damage from foreign objects such as dirt or hair so conventionally a filter is provided at the fluid inlet to the blower. The fan and heater require power in order to function and this is provided via internal wiring from either a mains power cable or batteries attached to the appliance.

Conventionally, a hairdryer has a body and a handle with a fluid flow path within the body and the controlling electronics within the handle. As hairdryers are used to dry wet hair it is desirable to provide some sort of sealing around the controls to prevent ingress of water, hair products or dirt which may affect the functioning of those controls.

SUMMARY OF THE INVENTION

Embodiments of the invention provide a hand held appliance comprising an outer wall, a user operable button, a switch mechanism, and a switch assembly wherein the switch assembly is housed within the outer wall and comprises a frame, an actuator and a flexible membrane which connects the actuator to the frame and wherein the actuator cooperates with both the switch mechanism and the user operable button.

An advantage of the invention is that the flexible membrane which enables movement of the button to change the state of the switch mechanism is located within the appliance rather than being exposed on the outer surface. This provides protection to the membrane from damage which could allow ingress of water, hair products or dirt and as a consequence impact the function of the appliance.

Preferably, the outer wall comprises an aperture and the user operable button engages with the actuator through the aperture.

In a preferred embodiment, the user operable button is spaced from the flexible membrane by the actuator. Thus, the user operable button does not engage directly with the flexible membrane.

Preferably, the actuator comprises a recess which engages with a corresponding protrusion that extends from the user operable button. This enables the user operable button to be attached to the actuator for example, by gluing.

In a preferred embodiment, the actuator comprises a second recess which engages with an activation knob of the switch mechanism.

Preferably, within the actuator the second recess is offset with respect to the recess.

Preferably, the flexible membrane extends around the entire perimeter of the actuator.

In a preferred embodiment, the switch mechanism is a slider switch.

Preferably, the switch mechanism has two positions and the actuator is sized so that regardless of the position of an activation knob of the switch mechanism only the actuator is visible through an aperture in the outer wall through which the user operable button engages with the actuator. This ensures that the flexible membrane is an internal component which is protected from damage by the actuator and the surrounding outer wall.

In a preferred embodiment, the membrane includes a bellows which extends around the actuator.

Preferably, the appliance comprises an inner wall which houses the switch mechanism wherein the switch assembly connects to the inner wall.

In a preferred embodiment, the frame comprises a pair of locating pins which cooperate with corresponding recesses in the inner wall to position the switch assembly with respect to the inner wall.

Preferably, the inner wall comprises an aperture through which an activation knob of the switch mechanism protrudes.

Preferably, the flexible membrane surrounds the actuator and comprises a protrusion that seals against the inner wall. Preferably, the protrusion extends along a longitudinal axis of the inner wall. In a preferred embodiment, the protrusion extends either side of the actuator along the longitudinal axis of the inner wall.

In a preferred embodiment, the outer wall is tubular. Preferably, the outer wall is formed as a single unit.

In a preferred embodiment, the user operable button is connected to the actuator through an aperture in the outer wall.

Preferably, the switch assembly includes a second actuator for actuating a second switch. In a preferred embodiment, the outer wall includes a second aperture and a second user operable button which engages with the second actuator through the second aperture.

Preferably, the appliance is a hair care appliance.

Preferably, the hair care appliance is a hairdryer. Alternatively, the hair care appliance is a hot styling appliance.

BRIEF DESCRIPTION OF THE DRAWINGS

The invention will now be described, by way of example only, with reference to the accompanying drawings, in which.

DETAILED DESCRIPTION OF THE INVENTION

Figure 1:
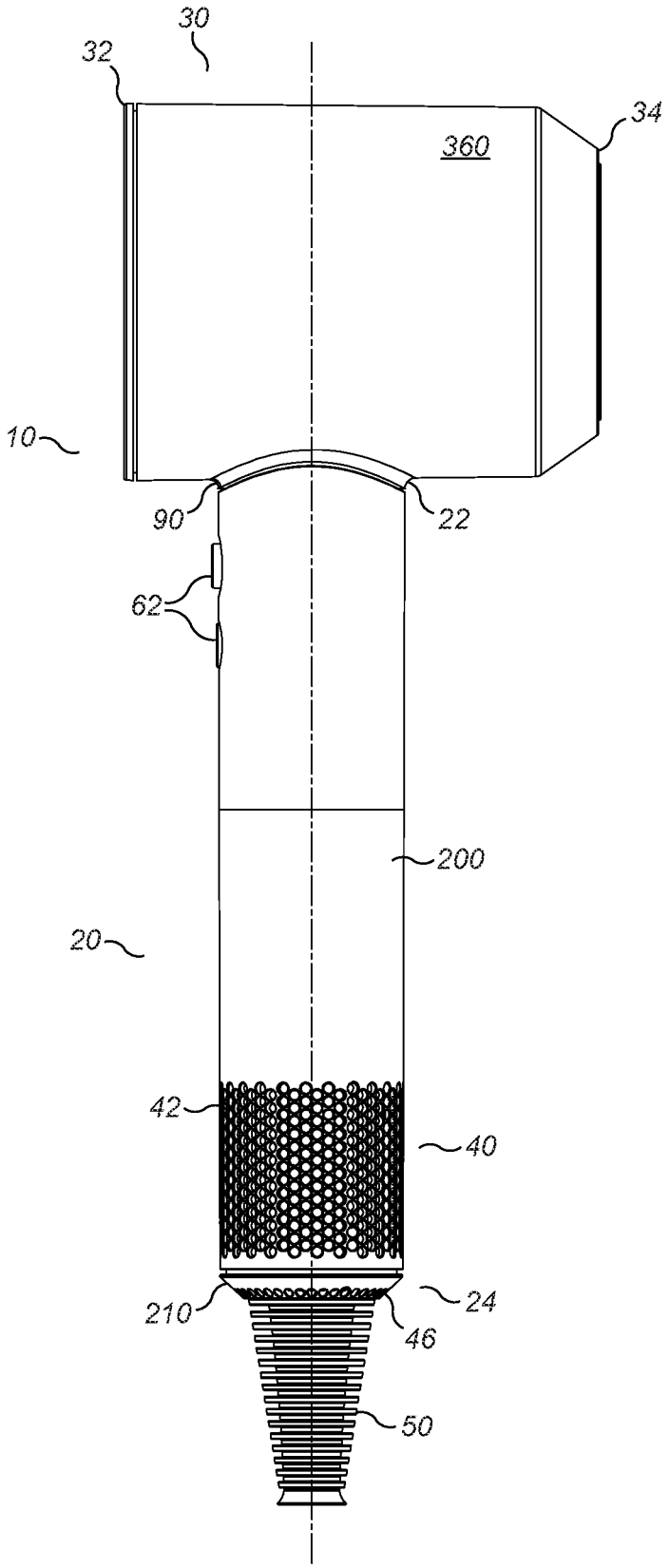
FIG. 1 shows a hairdryer according to the invention.
Figure 2:
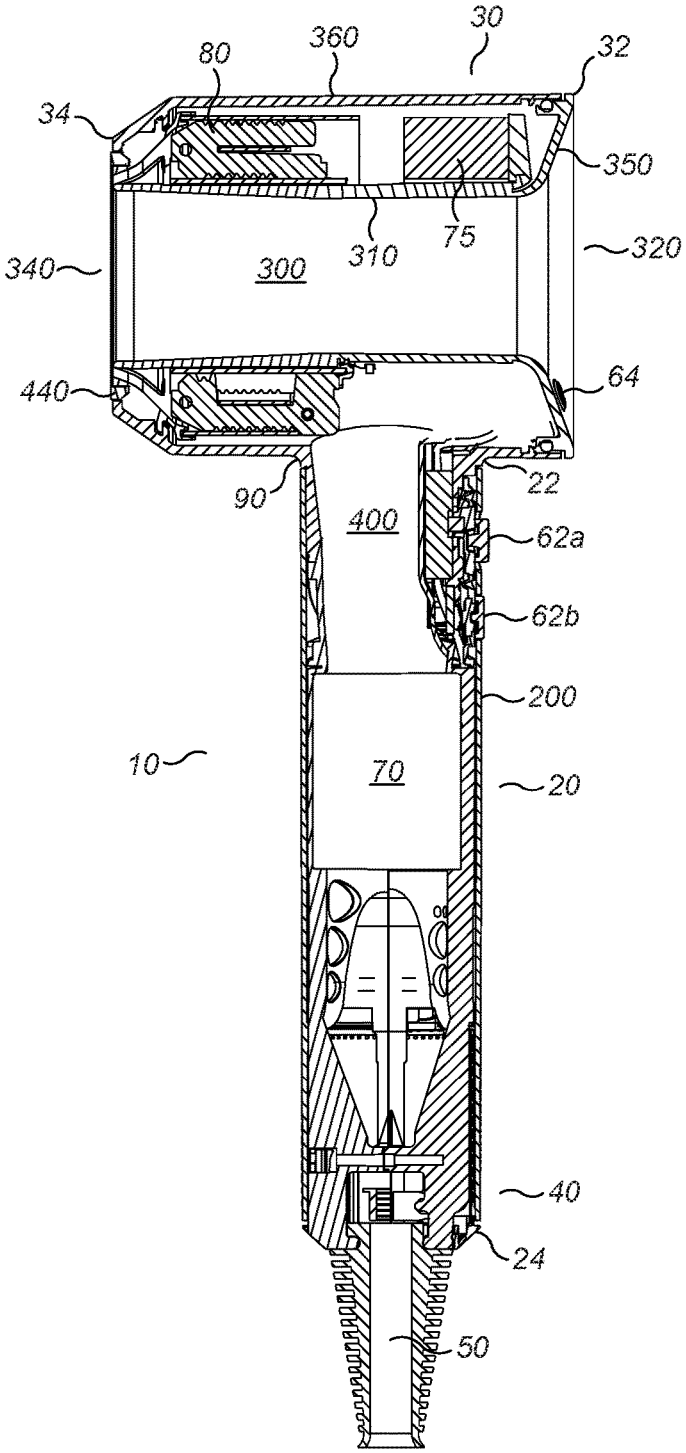
FIG. 2 shows a cross section through the hairdryer of FIG. 1.
Figure 3:
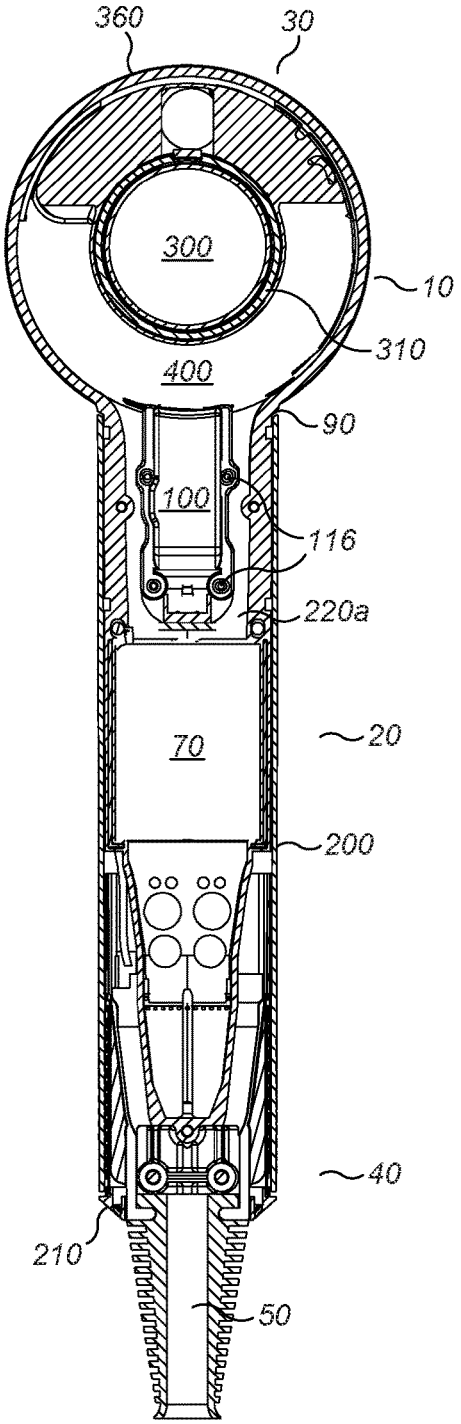
FIG. 3 shows a further cross section through the hairdryer of FIG. 1.
Figure 4:
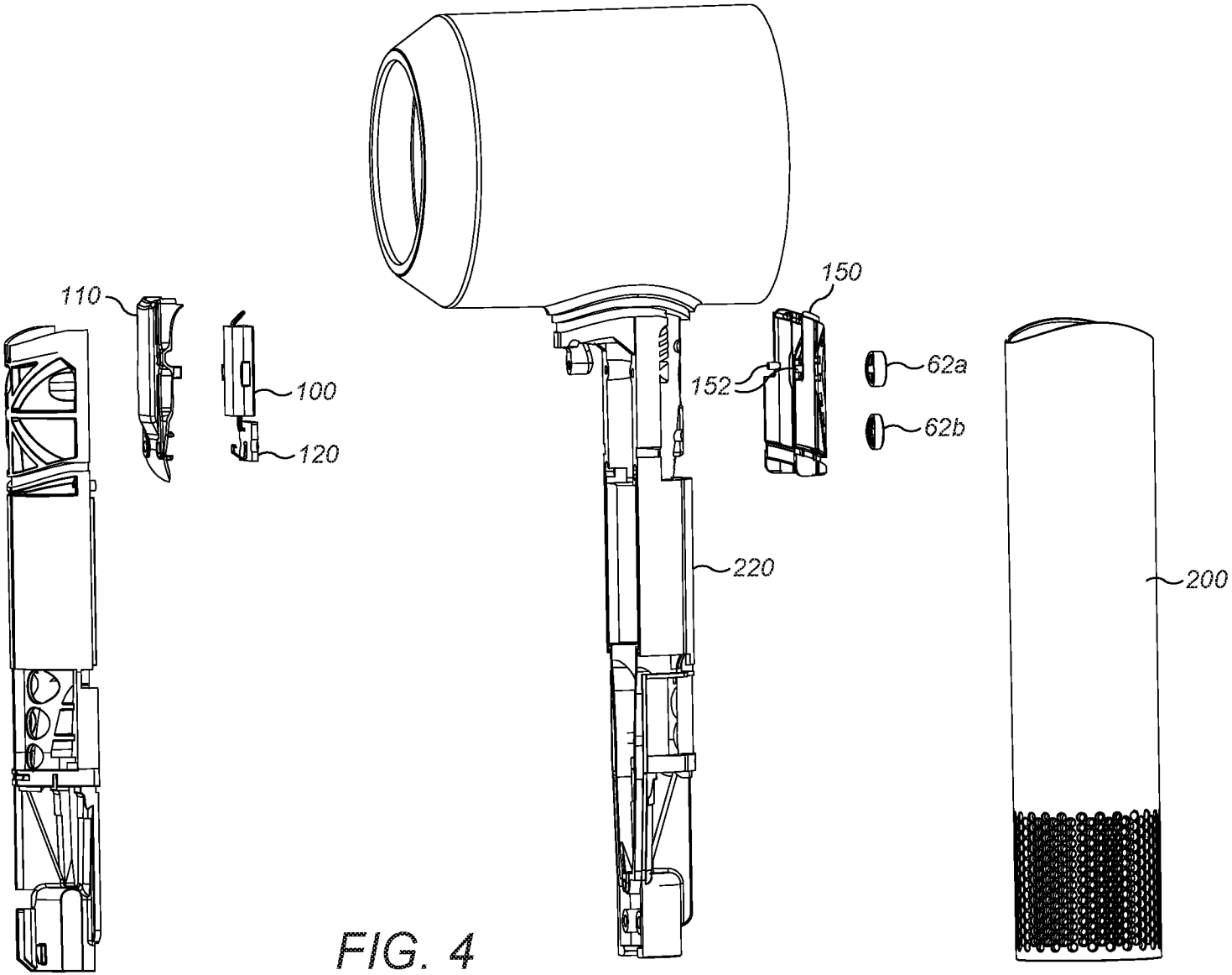
FIG. 4 shows an exploded view of some of the internal components of a hairdryer.
Figure 6:
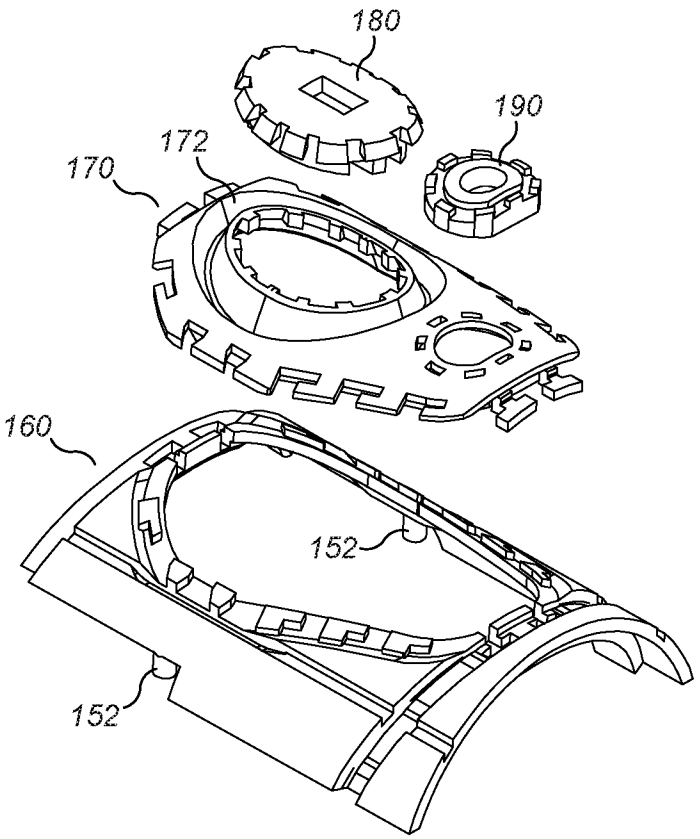
FIG. 6 shows an exploded view of the switch assembly of FIG. 5.
Figure 5:
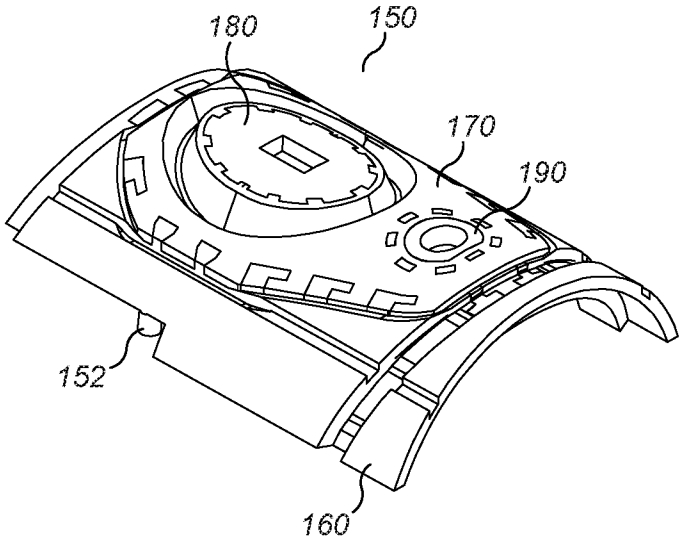
FIG. 5 shows an isometric view of a switch assembly according to the invention.
Figure 7:
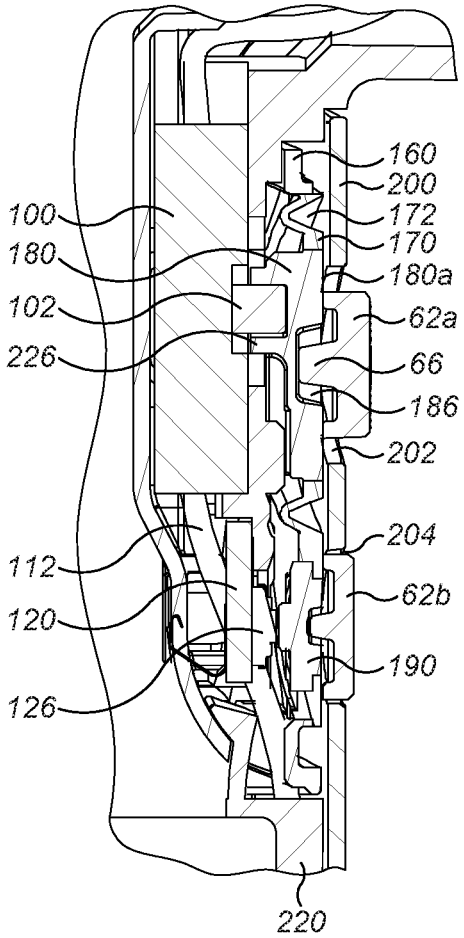
FIG. 7 shows an enlarged view of the cross-section shown in FIG. 2.
Figure 8:
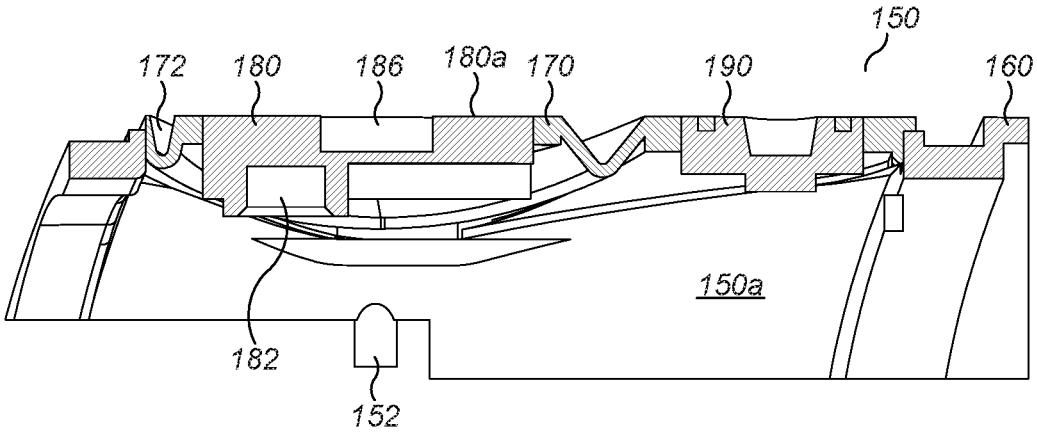
FIG. 8 shows a cross section through a switch assembly according to the invention.

FIGS. 1, 2 and 3 show a hairdryer 10 with a handle 20 and a body 30. The handle has a first end 22 which is connected to the body 30 and a second end 24 distal from the body 30 and which includes a primary fluid inlet 40. Power is supplied to the hairdryer 10 via a cable 50. At a distal end of the cable 50 from the hairdryer 10 a plug (not shown) is provided, the plug may provide electrical connection to mains power or to a battery pack for example.

The handle 20 has an outer wall 200 which extends from the body 30 to a distal end 24 of the handle. At the distal end 24 of the handle an end wall 210 extends across the outer wall 200. The cable 50 enters the hairdryer through this end wall 210. The primary fluid inlet 40 in the handle 20 includes first apertures that extend around and along 42 the outer wall 200 of the handle and second apertures that extend across 46 and through the end wall 210 of the handle 20. The cable 50 is located approximately in the middle of the end wall 210 so extends from the centre of the handle 20. The handle 20 has a longitudinal axis X-X along which the outer wall 200 extends from the body 30 towards the distal end 24.

Downstream of the primary fluid inlet 40, a fan unit 70 is provided. The fan unit 70 includes a fan and a motor. The fan unit 70 draws fluid through the primary fluid inlet 40 towards the body 30 through a primary fluid flow path 400 that extends from the primary fluid inlet 40 and into the body 30 where the handle 20 and the body 30 are joined 90. The body 30 has a first end 32 and a second end 34, the primary fluid flow path 400 continues through the body 30 towards the second end 34 of the body, around a heater 80 and to a primary fluid outlet 440 where fluid that is drawn in by the fan unit exits the primary fluid flow path 400. The primary fluid flow path 400 is non linear and flows through the handle 20 in a first direction and through the body 30 in a second direction which is orthogonal to the first direction.

The body 30 includes an outer wall 360 and an inner duct 310. The primary fluid flow path 400 extends along the body from the junction 90 of the handle 20 and the body 30 between the outer wall 360 and the inner duct 310 towards the primary fluid outlet 440 at the second end 34 of the body 30.

Another fluid flow path 300 is provided within the body 30; this flow is not directly processed by the fan unit 70 or the heater 80 but is drawn into the hairdryer 10 by the action of the fan unit producing the primary flow through the hairdryer. This fluid flow is entrained into the hairdryer by the fluid flowing through the primary fluid flow path 400.

The first end 32 of the body includes a fluid inlet 320 and the second end 34 of the body includes a fluid outlet 340. Both the fluid inlet 320 and the fluid outlet 340 are at least partially defined by the inner duct 310 which is an inner wall of the body 30 and extends within and along the body. A fluid flow path 300 extends within the inner duct 310 from the fluid inlet 320 to the fluid outlet 340. At the first end 32 of the body 30, a side wall 350 extends between the outer wall 360 and the inner duct 310. This side wall 350 at least partially defines the fluid inlet 320. The primary fluid outlet 440 is annular and surrounds the fluid flow path 300.

A printed circuit board (PCB) 75 including the control electronics for the hairdryer is located in the body 30 near the side wall 350 and fluid inlet 320. The PCB 75 is ring shaped and extends round the inner duct 310 between the inner duct 310 and the outer wall 360. The PCB 75 extends about the fluid flow path 300 and is isolated from the fluid flow path 300 by the inner duct 310.

The PCB 75 controls parameters such as the temperature of the heater 80 and the speed of rotation of the fan unit 70. Internal wiring (not shown) electrically connects the PCB 75 to the heater 80 and the fan unit 70 and the cable 50. The internal wiring consists of a live wire 112 and a neutral wire 122 that extend from the cable to the switch mechanism. Control buttons 62,64 are provided and connected to the PCB 75 to enable a user to select from a range of temperature settings and flow rates for example. Control button 62 comprises a pair of buttons. A first button 62*a* switches the product on and off and a second button 62*b* provides a second function, in this case a cold shot function.

In use, fluid is drawn into the primary fluid flow path 400 by the action of the fan unit 70, is optionally heated by the heater 80 and exits from the primary fluid outlet 440. This processed flow causes fluid to be entrained into the fluid flow path 300 at the fluid inlet 320. The fluid combines with the processed flow at the second end 34 of the body. In the example shown in FIG. 3, the processed flow exits the primary fluid outlet 440 and the hairdryer as an annular flow which surrounds the entrained flow that exits from the hairdryer via the fluid outlet 340. Thus fluid that is processed by the fan unit and heater is augmented by the entrained flow.

Referring to FIGS. 4 to 10 in particular, the invention will now be described. The switch assembly 150 includes a frame 160, a flexible membrane 170 and an actuator 180. The frame 160 provides a support for the switch assembly 150. The actuator 180 provides a support for the user operable button 62*a*. The flexible membrane 170 connects the actuator 180 to the frame 160 and allows the actuator 180 to be moved by a user operating the button 62*a* whilst providing a seal between the actuator 180 and the frame 160.

The switch assembly 150 is located within the handle 20 of the hairdryer 10. For convenience, the switch assembly 150 is connected to an inner wall 220 of the handle 20 via a pair of locating pins 152. The inner wall 220 includes an aperture 226 through which the switch assembly 150 can engage with the switch mechanism 100 when the switch assembly 150 is connected to the inner wall 220.

The different parts can be retained by mechanically fixing them together for example using glue, however in this embodiment, a switch cover 110 is used to house and retain the switch mechanism 150 with respect to the inner wall 220.

For the switch assembly 150, the locating pins 152 retain it with respect to the inner wall 200 and then when the outer wall 200 is positioned over the inner wall 220 by sliding the outer wall 200 along the inner wall 220, the switch assembly 150 is fixed in position. The outer wall 200 is provided with an aperture 202 through which button 62*a* cooperates with its' switch 100. Once the outer wall 200 is correctly located, the user operable button 62*a* is attached to the actuator 180 through aperture 202.

In this embodiment the switch mechanism 100 is a sliding switch with an activation knob 102. In order to accommodate the sliding action of the activation knob 102 and the actuator 180, the flexible membrane is provided with a bellows 172 which extends around the actuator.

The actuator 180 is provided with a recess 186 on the radially outer side or the face 180*a* of the actuator 180 which is adjacent the outer wall 200. This recess 186 cooperates with a protrusion 66 that extends from the user operable button 62*a*.

Figure 10:
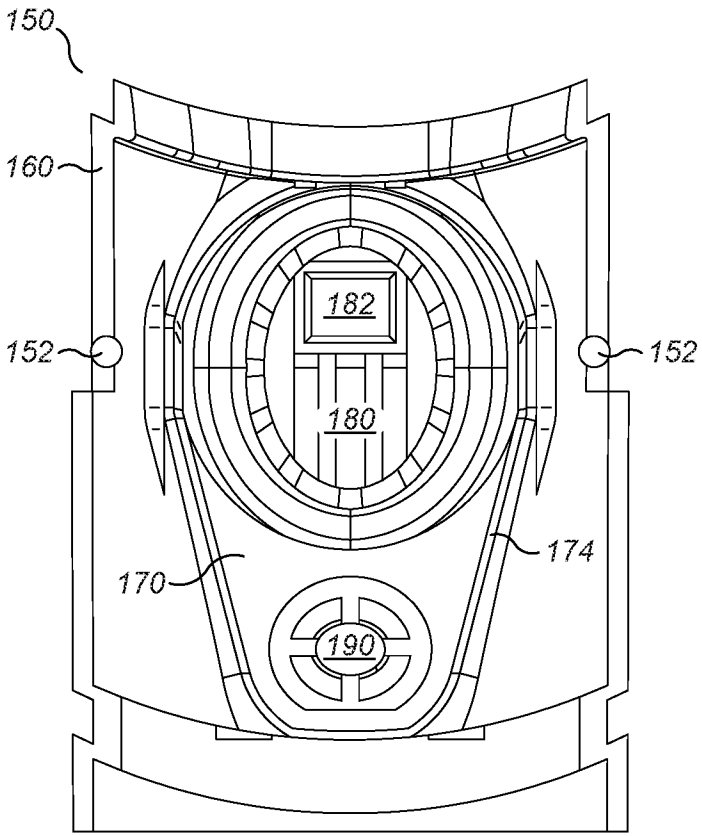
FIG. 10 shows the radially inner surface of the switch assembly of FIG. 5.
Figure 9:
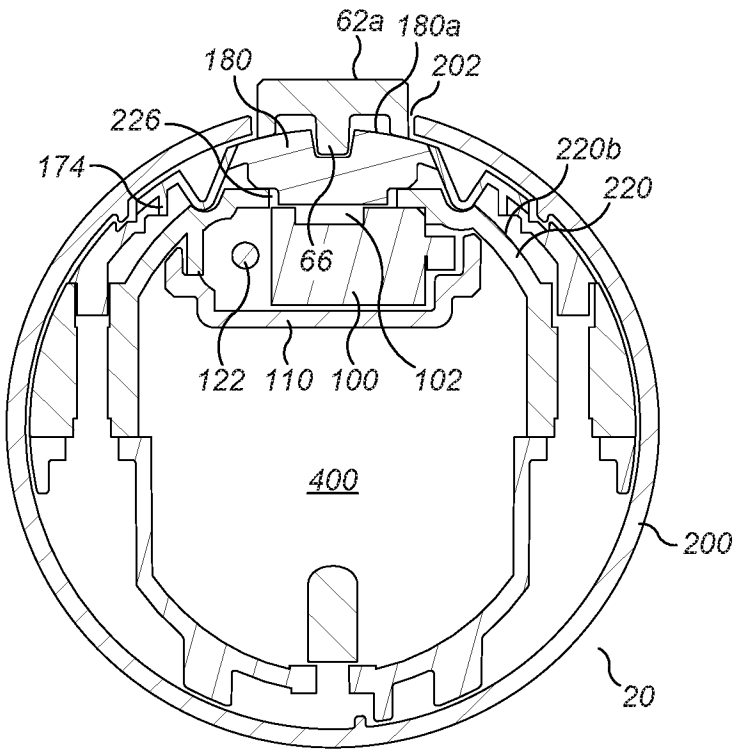
FIG. 9 shows a further cross section through the handle of hairdryer shown in FIG. 1.

The flexible membrane 170 is provided with a sealing lip 174 (FIGS. 9 and 10). This sealing lip 174 extends radially inwards from the radially inner surface 150*a* of the switch assembly. The sealing lip 174 extends along the longitudinal axis X-X of the handle 20 to seal around both the actuator 180 and the second actuator 190. The sealing lip 174 may also extend completely about the actuator 180 and the second actuator 190 to encapsulate them. Thus any fluid or dirt that passes between a user operable button 62*a*,62*b* and its' respective actuator 180,190 has a convoluted path between the inner wall 220 and the switch assembly 150, through the lip seal 174 and then between the inner wall 220 and the switch cover 110 in order to enter the fluid flow path 400.

The actuator 180 provides the means by which a movement of the user operable button 62*a* is communicated to the switch mechanism 100 and in particular the activation knob 102 of the switch mechanism 100. In this embodiment this communication is provided by two pairs of corresponding protrusions and recesses. As the switch mechanism 100 is provided with a protruding activation knob 102, the actuator is provided with a corresponding recess 182 adapted to house the activation knob 102 when the parts are assembled. This corresponding recess 182 is located on the radially inner side of the actuator 180 when assembled.

In order to minimise the thickness of the actuator 180 but to retain sufficient strength for the button 62*a* to be user operated, the corresponding recess 182 and the recess 186 are spaced apart. The recess 186 and the corresponding recess 182 are offset longitudinally within the actuator 180. In this embodiment, as the button 62*a* is pushed towards the body 12 of the hairdryer 10 in order to switch the hairdryer on, the corresponding recess 182 is positioned nearer the body 10 than the recess 186. The flexible membrane extends around the perimeter of the actuator to facilitate that the sliding action of the user operable button 62*a*.

The user operable button 62*a* is spaced from the flexible membrane 170 by the actuator 180. This means that the user does not engage directly with the flexible membrane 170 which might cause damage or wear over time. The actuator is sufficiently sized such that regardless of the position of the user operable button 62*a* only the actuator is visible through the aperture 202 in the outer wall 200. This provides a number of advantages including that there is always the relatively hard surface of the actuator 180 that surrounds the aperture 202 so the feedback to a user is consistent regardless of position of the user operable button, the location of the actuator with respect to engaging parts such as the switch mechanism 100 is maintained by the outer wall 200 and ingress of foreign objects is more limited than if the flexible membrane 170 were exposed through the aperture 202.

The outer wall 220 is tubular and moulded as a single unit. This limits the number of places where either fluid can escape from the fluid flow path or foreign mater can be introduced.

The switch assembly 150 additionally contains a second actuator 190 which is surrounded by the flexible membrane 170. The second actuator 190 is connected to a second button, in this case a cold shot button 62*b* which restricts or cuts power to the heater when activated to provide a cool flow from the hairdryer. The outer wall 200 is provided with a second aperture 204 through which the cold shot button 62*b* engages with the second actuator 190. When the cold shot button 62*b* is activated the actuator 190 engages with an electronic switch 126 which is housed on a PCB extension 120. This PCB extension 120 is electrically connected to the PCB 75 to provide signals to controlling software relating to activation and deactivation of the electronic switch 126. This cold shot button 62*b* is also attached to the second actuator 190 through the second aperture 204 after the outer wall 200 has been assembled over the inner wall 220.

Whilst a switch assembly having two user operable buttons has been described, the invention is not limited to this; depending on the positioning of user operable buttons, more than one switch assembly can be provided for an appliance.

The user operable buttons, whilst described as being a slider and a push button may be of any suitable type for the appliance being used; such alternatives will be apparent to the skilled person.

The outer wall 200 does not necessarily form part of a handle of the appliance and may comprise a flat or curved surface.

The invention has been described in detail with respect to a hairdryer however, it is applicable to any appliance that draws in a fluid and directs the outflow of that fluid from the appliance.

The appliance can be used with or without a heater; the action of the outflow of fluid at high velocity has a drying effect.

The fluid that flows through the appliance is generally air, but may be a different combination of gases or gas and can include additives to improve performance of the appliance or the impact the appliance has on an object the output is directed at for example, hair and the styling of that hair.

The invention is not limited to the detailed description given above. Variations will be apparent to the person skilled in the art.

The invention claimed is:

1. A hand held appliance comprising:
an outer wall comprising an aperture;
a user operable button that is positioned in the aperture and has an outer side for contacting by a user;
a switch mechanism; and
a switch assembly,
wherein the switch assembly is housed within the outer wall and comprises a frame, an actuator and a flexible membrane which connects the actuator to the frame,
wherein an outer side of the actuator contacts an inner side of the user operable button and an inner side of the actuator contacts the switch mechanism, and
wherein the actuator is larger than the aperture such that the actuator covers the aperture.

2. The appliance of claim 1, wherein the user operable button engages with the actuator through the aperture.

3. The appliance of claim 1, wherein the user operable button is spaced from the flexible membrane by the actuator.

4. The appliance of claim 1, wherein the actuator comprises a recess which engages with a corresponding protrusion that extends from the user operable button.

5. The appliance of claim 4, wherein the actuator comprises a second recess which engages with an activation knob of the switch mechanism.

6. The appliance of claim 5, wherein within the actuator the second recess is spaced from the recess.

7. The appliance of claim 1, wherein the flexible membrane extends around the entire perimeter of the actuator.

8. The appliance of claim 1, wherein the switch mechanism is a slider switch.

9. The appliance of claim 8, wherein the switch mechanism has two positions and the actuator is sized so that regardless of the position of an activation knob of the switch mechanism only the actuator is visible through the aperture in the outer wall through which the user operable button engages with the actuator.

10. The appliance of claim 8, wherein the flexible membrane includes a bellows which extends around the actuator.

11. The appliance of claim 1, comprising an inner wall which houses the switch mechanism wherein the switch assembly connects to the inner wall.

12. The appliance of claim 11, wherein the frame comprises a pair of locating pins which cooperate with corresponding recesses in the inner wall to position the switch assembly with respect to the inner wall.

13. The appliance of claim 1, wherein the frame comprises a pair of locating pins which cooperate with corresponding recesses in the inner wall to position the switch assembly with respect to the inner wall.

14. The appliance of claim 11, wherein the inner wall comprises an aperture through which an activation knob of the switch mechanism protrudes.

15. The appliance of claim 1, wherein the flexible membrane surrounds the actuator and comprises a protrusion that seals against the inner wall.

16. The appliance of claim 15, wherein the protrusion extends along a longitudinal axis of the inner wall.

17. The appliance of claim 15, wherein the protrusion extends on either side of the actuator along a longitudinal axis of the inner wall.

18. The appliance of claim 1, wherein the outer wall is tubular.

19. The appliance of claim 18, wherein the outer wall is formed as a single unit.

20. The appliance of claim 1, wherein the outer wall is formed as a single unit.

21. The appliance of claim 1, wherein the user operable button is connected to the actuator through an aperture in the outer wall.

22. The appliance of claim 1, wherein the switch assembly includes a second actuator for actuating a second switch.

23. The appliance of claim 22, wherein the outer wall includes a second aperture and a second user operable button which engages with the second actuator through the second aperture.

24. The appliance of claim 1, wherein the appliance is a hair care appliance.

25. The appliance of claim 24, wherein the hair care appliance is a hairdryer.

26. A hand held appliance comprising:

an inner wall forming a duct;

an outer wall extending around the inner wall;

a user operable button;

a switch mechanism housed within the inner wall; and a switch assembly, wherein the switch assembly is housed between an outer surface of the inner wall and an inner surface of the outer wall and comprises a frame, an actuator and a flexible membrane which connects the actuator to the frame, and wherein the actuator cooperates with both the switch mechanism and the user operable button.

* * * * *